US006142049A

United States Patent [19]

Schweitzer et al.

[11] Patent Number: 6,142,049

[45] **Date of Patent: *Nov. 7, 2000**

[54] LINERLESS LABEL CUT-OFF

[75] Inventors: James M. Schweitzer, Lancaster; Nancy Wantuch, Barker, both of N.Y.

[73] Assignee: Moore Business Forms, Inc., Grand Island, N.Y.

[ * ] Notice: Under 35 U.S.C. 154(b), the term of this patent shall be extended for 515 days.

[21] Appl. No.: 08/886,255

[22] Filed: Jul. 1, 1997

Related U.S. Application Data

[63] Continuation of application No. 08/544,132, Oct. 17, 1995, abandoned.

[51] Int. Cl.[7] ..... B26D 1/62; B26D 7/01

[52] U.S. Cl. ..... 83/349; 83/145; 83/649; 156/510

[58] Field of Search ..... 83/349, 145, 649; 221/70, 71; 156/521, 522, 510, 353; 400/621, 613; 242/613

[56] References Cited

U.S. PATENT DOCUMENTS

| | | | |
|---|---|---|---|
| 1,738,076 | 12/1929 | Molins . | |
| 3,558,254 | 1/1971 | Cahill | 83/649 |
| 3,587,376 | 6/1971 | Hirano et al. . | |
| 3,902,954 | 9/1975 | Lotto . | |
| 3,911,771 | 10/1975 | Schleifenbaum . | |
| 4,149,484 | 4/1979 | Koch . | |
| 4,294,145 | 10/1981 | Bodewein | 83/349 |
| 4,297,930 | 11/1981 | Putzke . | |
| 4,557,169 | 12/1985 | Kajiya et al. . | |
| 4,699,034 | 10/1987 | Sue | 83/649 |
| 4,784,714 | 11/1988 | Shibata | 156/354 |
| 4,840,696 | 6/1989 | Krasuski et al. | 156/353 |
| 4,892,019 | 1/1990 | Kogane et al. . | |
| 4,972,743 | 11/1990 | Nojima . | |
| 4,978,415 | 12/1990 | Jones | 156/517 |
| 5,134,915 | 8/1992 | Fukano et al. | 83/649 |
| 5,375,752 | 12/1994 | Michalovic . | |
| 5,417,783 | 5/1995 | Boreali et al. . | |
| 5,445,054 | 8/1995 | Pryor | 83/349 |
| 5,524,996 | 6/1996 | Carpenter et al. | 400/621 |
| 5,531,853 | 7/1996 | Cubow et al. | 156/521 |
| 5,560,293 | 10/1996 | Boreali et al. | 400/621 X |

FOREIGN PATENT DOCUMENTS

| | | | |
|---|---|---|---|
| 643570 | 5/1992 | Australia | 83/649 |
| 319209 A2 | 6/1989 | European Pat. Off. | 83/649 |
| 370642 | 5/1990 | European Pat. Off. . | |
| 567299 A1 | 10/1993 | European Pat. Off. | 83/649 |
| 0 577 241 A2 | 1/1994 | European Pat. Off. . | |
| 637547 | 2/1995 | European Pat. Off. . | |

*Primary Examiner*—Rinaldi I. Rada
*Assistant Examiner*—Charles Goodman
*Attorney, Agent, or Firm*—Nixon & Vanderhye P.C.

[57] ABSTRACT

A linerless label dispenser includes a cutting mechanism. Linerless labels are transported from a roll underneath a plastic guide and onto an adhesive-release material guide structure/ramp past a sensor to a print head which prints indicia on the release material coated face of the labels. From the print head and cooperating print roller the labels pass to a plasma coated stripper surface which is disposed at an upwardly directed angle between about 20–35° with respect to the horizontal, and into contact with a plasma coated stationary anvil blade. The anvil blade is spaced downwardly from the stripper surface a distance of about 0.001–0.008 inches (preferably about 0.002–0.004 inches) and cooperates with a plasma coated or texture painted rotary blade of a rotary cutter. Downstream of the blades may be a plasma coated exit roller typically cooperating with a hold down mechanism for dispensing individual cut labels.

11 Claims, 3 Drawing Sheets

LINERLESS LABEL CUT-OFF

This is a continuation of application Ser. No. 08/544,132, filed Oct. 17, 1995, now abandoned.

BACKGROUND AND SUMMARY OF THE INVENTION

The use of linerless labels is becoming widespread due to relatively low cost of such labels and due to their relative environmental friendliness. A number of different dispensers has been developed—such as shown in U.S. Pat. Nos. 5,375,752 and 5,417,783, European published application 0577241, and co-pending U.S. application Ser. No. 08/312,068 filed Sep. 26, 1994—to facilitate dispensing of such labels. Each of those dispensers is particularly suited for certain dispensing requirements and can successfully dispense linerless labels without prohibitive difficulties. However, there are some circumstances for which such dispensers are not ideally suited, and therefore the linerless label dispenser according to the present invention—and its associated cutting mechanism—have been developed.

The linerless label dispenser, and its associated cutting mechanism, according to the present invention are ideally suited for dispensing linerless labels from a roll even when the labels are not perforated on the roll. The dispenser can automatically print the labels just prior to dispensing, and dispenses them in a manner that substantially avoids jamming of the printer or the cutting mechanism.

According to one aspect of the present invention a linerless label dispenser is provided comprising the following components: A support for a supply of continuous form linerless labels, each label having a pressure sensitive adhesive face and an adhesive-release material coated face. An adhesive-release material guide structure for engaging the adhesive face of labels from the supply of labels. A print head, on the opposite side of the guide structure from the supply of labels, for printing the release material coated face of labels from the supply of labels. A stripper surface on the opposite side of the print head from the release material structure, the stripper surface of adhesive-release material. A stationary anvil blade, on the opposite side of the stripper surface from the print head, for engaging the adhesive face of labels from the supply of labels. And an automatic rotary cutter cooperating with the stationary anvil blade for engaging the release material coated face of labels from the supply of labels, and cutting individual labels to be dispensed from the supply of continuous form of linerless labels.

The support for the continuous form linerless labels preferably comprises a conventional shaft for supporting the core of a roll of linerless labels. The linerless labels may either be perforated, or may have marks applied thereto indicating the approximate position at which the web of labels from the roll are to be severed into individual labels.

The adhesive-release material guide structure may be mounted adjacent a plastic guide which engages the release material face of the labels, and preferably the adhesive-release material thereof is a plasma coating such as disclosed in U.S. Pat. No. 5,375,752, the disclosure of which is hereby incorporated by reference herein.

After the guide structure of the labels typically pass under a sensor which either senses the perforations or marks indicating the division between labels, which cooperates with a control mechanism for the printer and subsequent rotary cutter. The print head may be of any conventional type that is capable of printing on the release material, preferably a non-impact printer such as an ink jet printer. Where a thermosensitive coating is also provided for the labels, the print head may be a thermal print head or a thermal transfer print head. Typically the print head cooperates with a print roller, which also is plasma coated. (The print roller in the case of thermal or ink jet is made of a silicone covered core, available from Silicone Products & Technology, Inc. of Lancaster, N.Y.)

Just downstream of the print head is a support which supports the stripper surface and the stationary anvil blade, the stripper surface preventing adherence of the labels to the print roller and enabling passage of the labels downstream to the rotary cutter without adherence to parts of the dispenser. The adhesive-release material of the stripper surface preferably also is a plasma coating, and the stripper surface is disposed at an upwardly directed (from the print head) angle of between about 20–35° (preferably about 27°) with respect to the horizontal so that the labels printed by the print head move upwardly at an angle from the print head to the rotary cutter. The provision of such an angle has been found to minimize jams of the printer and the cutter. A stripper surface also may have a plurality of upwardly extending extensions formed on at least a part thereof (e.g. a portion of between 5–20% of the width of a linerless label passing thereover) for decreasing the surface tension thereof.

The stationary anvil blade is preferably also plasma coated and is immediately adjacent the stripper surface. Alternatively, the stationary block may be painted with a textured paint. (The actual cutting surfaces are not plasma coated or textured painted, just the supporting pieces.) It has been found according to the present invention that jamming of the printer and rotary cutter are minimized if the anvil blade is spaced downwardly from a stripper surface a sufficient distance to insure that the leading edge of the label (the edge being cut) is not smashed. It has been found that a spacing of between about 0.001–0.008 inches (preferably about 0.002–0.004 inches) is most effective.

The rotary cutter may comprise a conventional off the shelf structure, except for the plasma coated rotary blade, such as a Hitachi rotary cutter Model #V15A.

Under some circumstances it is desirable to have an exit roller downstream of the rotary cutoff mechanism to facilitate dispensing of the cut labels, such as through an exit opening in a housing. Such an exit roller, when provided, also preferably has a plasma coated surface, and that surface is also preferably grooved (between about 5–20% of the width of a linerless label engaged thereby) and typically cooperates with a hold down mechanism of any conventional type.

According to another aspect of the present invention a cutting mechanism per se for linerless labels (each having a pressure sensitive adhesive face and an adhesive-release material coated face) is provided. The cutting mechanism comprises the following elements: A stripper surface of adhesive-release material for engaging the adhesive face of linerless labels, and making an angle with respect to the horizontal of between 20–35 degrees. A stationary anvil blade adjacent the stripper surface for engaging the adhesive face of linerless labels. And a rotary cutter cooperating with the stationary anvil blade for engaging the release material coated face of linerless labels and cutting the labels.

The rotary cutter typically includes a rotary blade and the stationary and rotary blades are preferably plasma coated or texture painted. The orientation and dimensioning of the stripper surface and anvil blade preferably are as described above for the dispenser.

It is a primary object of the present invention to provide an effective linerless label dispenser and a cutting mechanism for use therewith. This and other objects of the invention will become clear from an inspection of the detailed description of the invention, and from the appended claims.

DETAILED DESCRIPTION OF THE DRAWINGS

Figure 1:
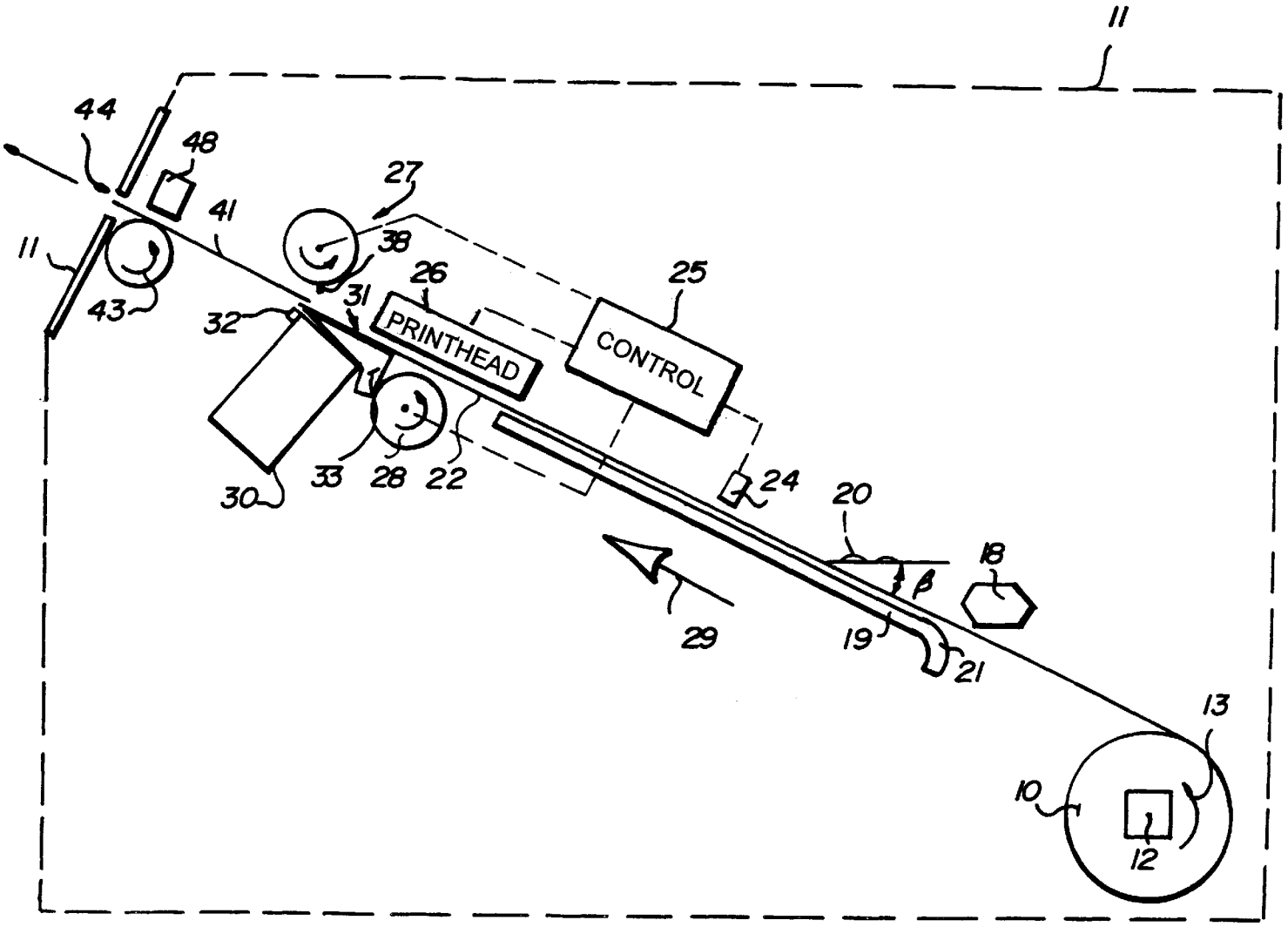
FIG. 1 is a side schematic view of an exemplary linerless label dispenser according to the present invention.

FIG. 1 schematically illustrates an exemplary dispenser that may be provided according to the present invention for dispensing linerless labels e.g. in a roll 10 which is a supply of continuous form linerless labels. The linerless labels in the roll 10 may either have perforations between the labels, or may be devoid of perforations. Sensor marks may be provided so that when a label begins and ends may be determined. The dispenser illustrated in FIG. 1 may include a common housing shown merely in dotted lines schematically at 11 in FIG. 1.

The supply of linerless labels 10 is mounted on a support. The support is illustrated only schematically at 12 in FIG. 1, but it may comprise any conventional shaft or related mounting for the core of a roll of labels 10, such as shown in U.S. Pat. Nos. 5,375,752 and 5,417,783 or EPO patent application 0577241. The roll 10 rotates in a direction indicated by arrow 13 as the labels are taken off the roll 10, decreasing in size. The linerless labels forming the roll 10 are—as is common for all linerless labels—formed by (see the schematic illustration in FIG. 3) a substrate 14, typically of paper, with a pressure sensitive adhesive coating 15 on one face thereof and an adhesive release material coating (e.g. silicone) 16 on the other face thereof.

From the roll 10 the linerless labels preferably pass underneath a plastic guide 18 which engages the release material coating 16 face thereof, and then to an adhesive-release material guide structure 19 which engages the adhesive face 15. Preferably the structure 19 comprises a plasma coated ramp, for example disposed at an angle β with respect to the horizontal (indicated at 20 in FIG. 1). The angle β is typically between about 20–35° (e.g. about 27°). The ramp 19 preferably includes an arcuate lead-in portion 21.

Linerless labels in continuous form, illustrated schematically at 22 in the drawings, typically pass underneath the sensor 24, such as a conventional optical sensor. The sensor 24 senses either the perforation lines between individual labels of the web 22, or applied marks for that purpose indicating the demarcation between labels. Sensor 24 may cooperate with a computer control 25 or the like, computer control 25 also typically controlling a print head illustrated schematically at 26 in FIG. 1, and a rotary cutter, illustrated schematically at 27 in FIG. 1, and in more detail in FIG. 2. After receiving input from sensor 24 the control 25 properly controls the print head 26 and cutter 27.

The print head 26 cooperates with the release material face 16 of the web 22 to print indicia thereon, typically variable indicia under the control of the computer control 25. The printer 26 may be any suitable type that can print on the release material face 16, such as a non-impact printer like an ink jet printer. Where the web 22 comprises linerless labels with a thermosensitive coat beneath a release coating 16, or surrounded thereby (as is conventional in the art), the print head 26 may be a thermal or thermal transfer print head. Normally the print head 26 cooperates with the print roller 28, the roller 28 preferably being a silicone covered shaft so as to have adhesive-release properties.

Figure 2:
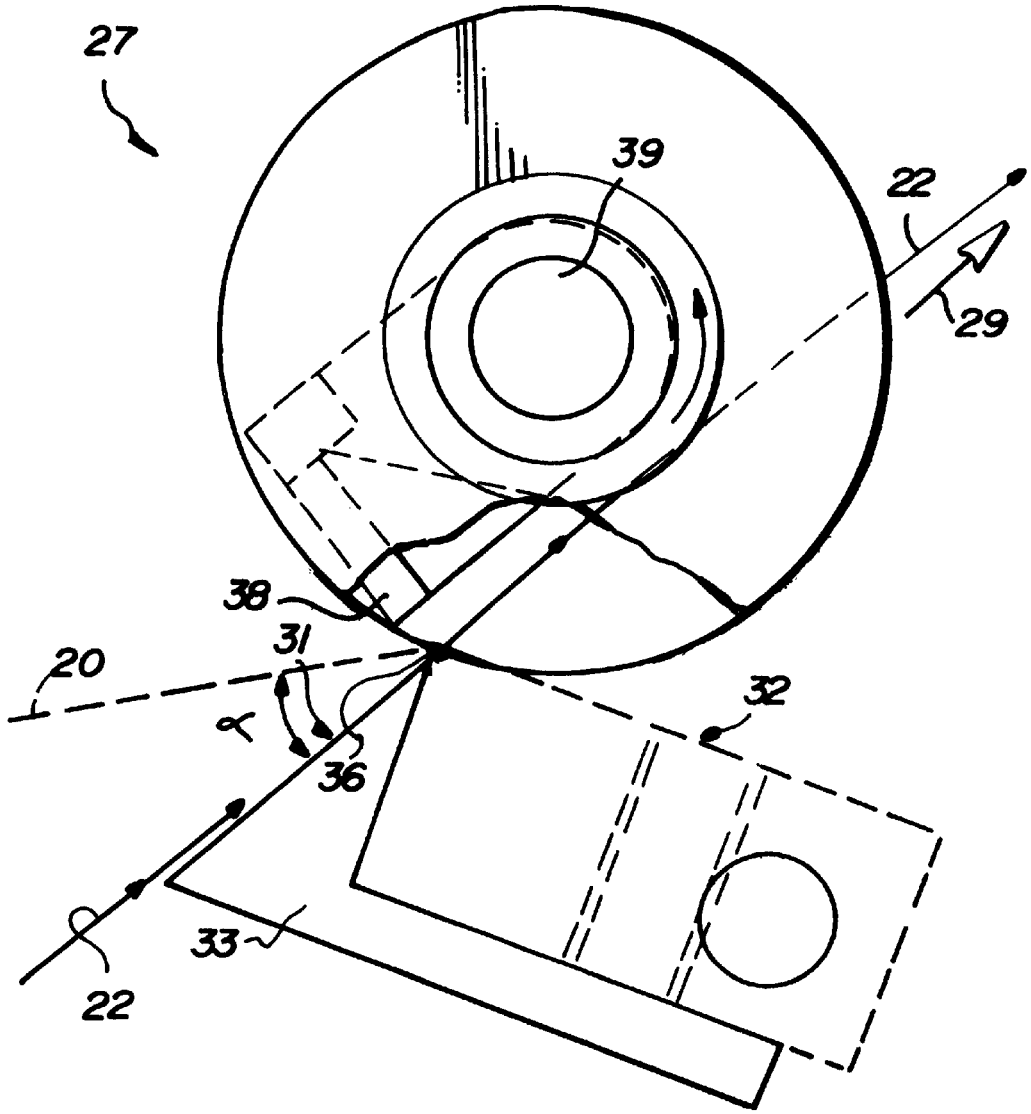
FIG. 2 is a detail side elevational view, with portions cut away for clarity of illustration, of the stripper surface and cutting mechanism of the dispenser of FIG. 1.

Downstream in the direction of movement of the label 22, which direction is illustrated by the arrow 29 in FIGS. 1 and 2, is a support 30. The support 30 preferably supports a stripper surface 31, seen in FIGS. 1 through 3, and a stationary anvil blade 32. The stripper surface 31 is preferably a generally planar surface of a block or other shape of metal 33, the surface 31 being plasma coated so that it will not stick to the adhesive 15 which it engages. The stripper surface 31 is disposed at the angle α (see FIG. 2) with respect to a horizontal direction 20, the angle α typically being about the same as the angle β, that is between about 20–35°, preferably about 27°. As seen in FIGS. 1 and 2, the surface 31 is upwardly directed from the print head 26 toward the rotary cutting mechanism 27, which has been found to minimize jamming.

Figure 3:
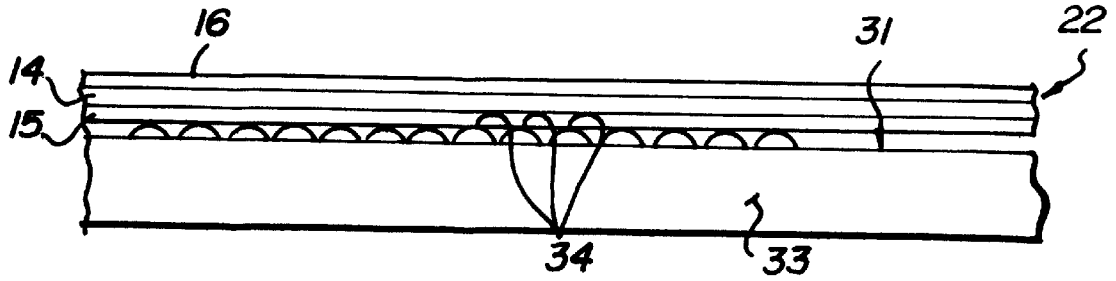
FIG. 3 is an enlarged partial front end view of the stripper surface of FIGS. 1 and 2 showing the linerless label, also enlarged for clarity of illustration, in association therewith.

As illustrated schematically in FIG. 3, the surface 31 may include a plurality of upwardly extending extensions 34 formed on at least a part thereof. For example, twenty such extensions 34 may be formed on the surface 31, the total extent of the extensions 34 being between about 5–20% of the width of the linerless label 22 passing thereover. The purpose of the extensions 34 (which are also plasma coated) is to decrease the surface tension, i.e., the frictional resistance, of the stripper surface 31 to the labels and thereby minimize the possibility of the adhesive sticking thereto, the extensions with the non-stick coating thereby decreasing the frictional resistance to the passage of the labels in a downstream direction over the surface 31. That is, the extensions 34 reduce the frictional resistance of the stripper surface to the passage of the labels by reducing the surface area of the surface 31 which would otherwise be in contact with the adhesive side of the labels. The reduction in surface area from what would otherwise be a full surface area over the length and width of the surface reduces the frictional resistance of the labels to passage over the surface. While the extensions 34 are illustrated as dimples in FIG. 3, they may have any desired operable configuration and relative dimensions.

Immediately downstream of the stripper surface 31 is the anvil blade 32. The anvil blade 32 is of hardened steel or the like, and preferably also is texture painted [since practical technology does not presently exist for plasma coating hardened steel], at least the portions thereof that are likely to come into contact with the adhesive 15 of labels being cut. Suitable textured paint is available from Decora Mfg. Inc. of Fort Edward, N.Y. or Sagimore Industrial of Amesbury, Mass. The hardened blade 32 has a portion 36 thereof which is spaced downwardly from the stripper surface 31 and upwardly from the support 30. The amount of spacing is preferably between about 0.001–0.008 inches, most preferably between about 0.002–0.004 inches. It has been found that this slight, but significant, downward spacing of the portion 36 of the blade 32 also minimizes jamming of the entire dispenser, particularly the print head 26 and the rotary cutter 27. If the anvil blade 32 were above the surface 31 of the stripper, the leading edge of the label would catch on the blade 32. The blade 32 does however extend upwardly from the support 30. The distance from which the blade is below the surface of the stripper and above the support is approximately the same, 0.002–0.004" with a range of 0.001–0.008". But by being raised slightly from the support (but below the stripper surface) the leading edge of the label is not smashed into the recess.

The rotary cutter 27 typically includes a rotary blade 38 mounted on a rotating, powered, shaft 39 (e.g. typically powered by an electrical motor under the control of computer control 25). The rotary blade 38—even though it initially engages only the release material face 16 of the web 22—preferably also is plasma coated or texture painted. The blade 38 cooperates with the blade 32 portion 36 to sever the linerless label web 22 into individual labels, such as the individual label 41 illustrated schematically in FIG. 1 downstream of the rotary cutter mechanism 27 in the direction 29. The rotary cutting mechanism 27 may be (except for plasma coatings) an off the shelf rotary cutter, such as a Hitachi rotary cutter Model #V15A, or Hengstler Series 0 685.4. The Hitachi cutter blades are made of two pieces, a steel support and a hardened insert. The insert is not coated.

In order to even further prevent sticking of the adhesive 15 of the web 22 to the anvil blade 32, after a cut is made the web 22 may be retracted slightly (moved in a direction opposite the direction 29), on the order of about one-eighth to one inch. This would be accomplished by the computer control 25 reversing the direction of the print roll 28, or reversing the direction of other conveyance mechanisms (such as rollers, belts, or the like) that may be associated with the dispenser of FIG. 1, but are not illustrated in FIG. 1.

Figure 4:
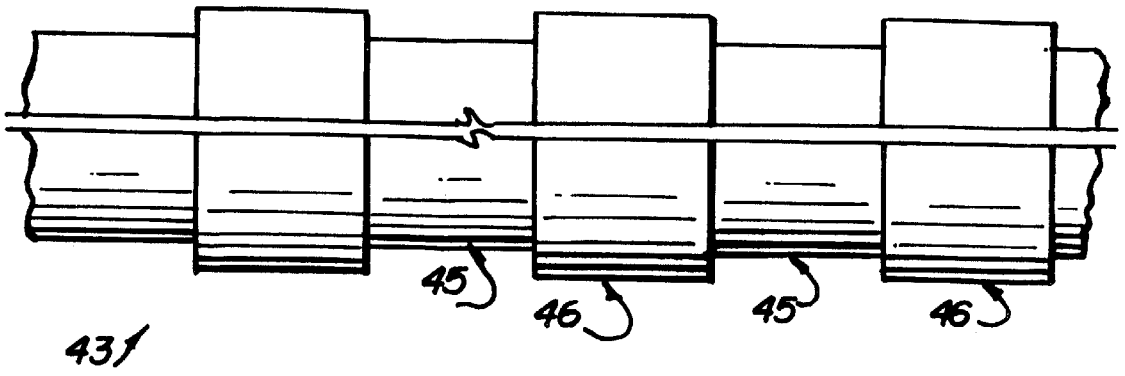
FIG. 4 is a partial front end view of an exemplary construction of an exit roller of the dispenser of FIG. 1.

Downstream of the cutter 27 an exit roller 43 may be provided. While the exit roller 43 is not essential, it does help in dispensing cut labels 41 through an exit opening 44 in the housing 11. The exit roller 43 also is preferably plasma coated, and since it is very important the labels not stick to it (since that would preclude dispensing thereof through the opening 44), the plasma coated surface of the roller 43 may be grooved to reduce the overall surface and hence frictional resistance of the roller 43 to the passage of the labels. One configuration the grooving might take is illustrated schematically in FIG. 4 where annular depressions 45 are provided between annular lands 46. The grooving of the roller 43 need not necessarily be over the entire width thereof, but—as with the extension 34 of the surface 31—may be provided over a portion equal to about 5–20% of a width of a linerless label passing thereover.

The exit roller 43 may cooperate with a conventional hold down mechanism, illustrated only schematically at 48 in FIG. 1. The hold down mechanism may be of any conventional type, engaging the release material coated face 16 of the label 41. For example, it may be another roller either gravity or spring pressed into place, or a low friction material slide either gravity or spring pressed into place, or spring fingers exerting light downward pressure, or other conventional mechanisms.

With respect to all of the adhesive release surfaces described above it is preferred that they are plasma coated. However, under some circumstances they may comprise other release materials, such as silicone coatings or textured paint.

It will thus be seen that according to the present invention a simple yet versatile yet effective linerless label dispenser, and cutting mechanism for linerless labels, have been provided. While the invention has been herein shown and described in what is presently conceived to be the most practical and preferred embodiment thereof, it will be apparent to those ordinary skill in the art that many modifications may be made thereof within the scope of the invention, which scope is to be accorded the broadest interpretation of the appended claims so as to encompass all equivalent structures and devices.

What is claimed is:

1. A linerless label dispenser, comprising:

a support for a supply of continuous form linerless labels, each label having a pressure sensitive adhesive face and an adhesive-release material coated face;

a guide structure having adhesive release material thereon for engaging the adhesive face of labels from said supply of labels and guiding the labels for movement in a downstream direction;

a print head, on a downstream side of said guide structure from said supply of labels, and in registration with the continuous form linerless labels on their adhesive-release material coated faces for printing the release material coated face of labels from said supply of labels;

a surface, on the downstream side of said print head from said guide structure, said surface having adhesive-release material thereon;

a stationary anvil blade, on the downstream side of said surface from said print head, for engaging the adhesive face of labels from said supply of labels;

an automatic rotary cutter cooperating with said stationary anvil blade for engaging the release material coated face of labels from said supply of labels, and cutting individual labels to be dispensed from said supply of continuous form linerless labels;

said surface being disposed at an upwardly directed angle of between about 20–35 degrees with respect to a horizontal direction so that the labels printed by said print head move upwardly at an angle from said print head to said rotary cutter;

said surface having a plurality of upwardly extending extensions formed thereon for decreasing frictional resistance of said surface to the labels; and an exit roller disposed on an opposite side of said rotary cutter from said print head, said exit roller having an adhesive-release material surface engaging the adhesive face of a cut label, for conveying and dispensing the cut label.

2. A dispenser as recited in claim 1 wherein said surface extensions are provided over a portion of said surface of between 5–20% of a width of a linerless label passing thereover.

3. A dispenser as recited in claim 1 wherein said stationary anvil blade is spaced downwardly from said surface a distance of about 0.001–0.008 inches, and is immediately adjacent said surface.

4. A dispenser as recited in claim 3 wherein said surface is disposed at an angle of about 27 degrees to said horizontal direction and said stationary anvil blade is spaced from said surface between about 0.002–0.004 inches.

5. A dispenser as recited in claim 1 further comprising a hold down structure cooperating with said exit roller and for engaging the release material face of the cut label being dispensed by said exit roller.

6. A dispenser as recited in claim 5 wherein said exit roller has a grooved surface engaging the adhesive face of the cut label, for reducing frictional resistance of said roller to the labels.

7. A dispenser as recited in claim 6 wherein grooves of said grooved surface cover a portion of said grooved surface of between about 5–20% of a width of a linerless label engaged by said exit roller.

8. A dispenser as recited in claim 1 further comprising a print roller having a surface of adhesive-release material cooperating with said print head.

9. A dispenser as recited in claim 8 further comprising a plastic guide between said label supply support and said guide structure, linerless labels from said supply passing between said plastic guide and said guide structure.

10. A dispenser as recited in claim 1 wherein said stationary anvil is immediately adjacent said stripper surface; and wherein said anvil blade is plasma coated or texture painted.

11. A dispenser according to claim 1 in combination with said continuous form linerness labels, with each label having a pressure sensitive adhesive face and an adhesive-release material coated face on opposite sides of the label.

* * * * *